US006352445B2

(12) United States Patent
Takei et al.

(10) Patent No.: US 6,352,445 B2
(45) Date of Patent: Mar. 5, 2002

(54) CONNECTOR FOR MEMORY CARDS

(75) Inventors: Kazunori Takei; Hitoshi Kikuchi; Kazuhiro Sato; Sadao Kuboi; Takanobu Yoshimi, all of Tokyo (JP)

(73) Assignee: DDK Ltd. (JP)

( * ) Notice: Subject to any disclaimer, the term of this patent is extended or adjusted under 35 U.S.C. 154(b) by 0 days.

(21) Appl. No.: 09/871,205

(22) Filed: May 31, 2001

(30) Foreign Application Priority Data

Jun. 2, 2000 (JP) ..... 2000-165932
Jun. 22, 2000 (JP) ..... 2000-187209

(51) Int. Cl.[7] ..... H01R 3/00

(52) U.S. Cl. ..... 439/489; 439/218; 439/188; 439/541.5; 439/64

(58) Field of Search ..... 439/631, 632, 439/489, 541.5, 188, 64, 159, 326, 377

(56) References Cited

U.S. PATENT DOCUMENTS 5,176,523 A * 1/1993 Lai ..... 439/64
5,370,544 A * 12/1994 Reichardt et al. ..... 439/188
5,653,596 A * 8/1997 Banakis et al. ..... 439/64
5,820,391 A * 10/1998 Delprete et al. ..... 439/489

* cited by examiner

*Primary Examiner*—P. Austin Bradley
*Assistant Examiner*—Briggitte R. Hammond
(74) *Attorney, Agent, or Firm*—Baker Botts LLP

(57) ABSTRACT

A connector for memory cards includes a connector body having side walls on both sides and a rear wall. The side walls are formed over their length with card receiving portions to meet shapes of side edges and the number of the memory cards to be used. The connector further includes card identification terminals made of a springy metal strip arranged in a plurality of steps in inner surface of one of the side walls, identification tabs arranged spaced from the card identification terminal prior to insertion of a card, for identifying an existence of an inserted card with the aid of the contact between the inserted card and the card identification terminal, and terminals suitably arranged on the rear wall for writing electronic information into cards and reading stored information from cards. Each of the card identification terminals includes a contact portion to contact the card, a fixing portion to be fixed to the connector body, and a connection portion to be connected to a board and further includes an engaging portion on an extension of the contact portion, which engaging portion engages an anchoring portion of each of insertion grooves formed in the connector body.

7 Claims, 7 Drawing Sheets

CONNECTOR FOR MEMORY CARDS

BACKGROUND OF THE INVENTION

This invention relates to a connector for a plurality of memory cards different in thickness and type, which selectively receives these memory cards and is able to detect or identify the different cards and to prevent terminals provided in the connector from buckling when a card is inserted into the connector.

Memory cards different in thickness as media for information have been mounted on and connected to information apparatuses through a respective connector exclusive to one particular type of the memory card among the number of the memory cards for reading information stored in the card and storing information into the card. In assembling the connector of the prior art, moreover, terminals used for identifying card are inserted into the connector from the opposite side of card insertion opening of the connector and fixed thereat so as to permit free ends of the terminals to be free or movable.

In recent years, the information apparatuses and hence their boards have been rapidly miniaturized, so that areas occupied by the boards have been limited, as a result of which a pluralization of the board has naturally been introduced. On the other hand, it is very inconvenient to have a plurality of connectors exclusive to the memory cards as described above, particularly in exchanging the memory cards. What is worse still, the plurality of connectors make larger the information apparatuses, which are incompatible with the miniaturization and in no way suitable for portable apparatuses.

In the connectors for memory cards of the prior art, moreover, the free ends of the terminals are free or not restrained as described above. Therefore, when the cards are being inserted into the connectors, cards tend to jam with contact portions of terminals to cause buckling of the cards, leading to wrong electrical connection. With the free ends of the terminals not restrained, furthermore, substantially constant contact pressure between the cards and the terminals could not be obtained owing to irregularity in gaps between the terminals, so that stable contact between the cards and the terminals could not be obtained.

SUMMARY OF THE INVENTION

It is an object of the invention to provide an improved connector for memory cards, which eliminates any irregularity in gap between terminals to obtain a stable contact between terminals and card, and prevents terminals from being buckled when a card is inserted into the connector, thereby preventing any wrong electrical connection and which is able to selectively receive a plurality of cards different in thickness and type to operate information apparatuses without requiring any change in areas occupied by boards.

The connector according to the invention can be used without the aid of any other connectors for identifying a plurality of kinds of memory cards used with great frequency and includes card identification terminals provided on inner surfaces of connector side wall steps or inner surfaces of card insertion spaces. With steps provided for receiving the cards, the card identification terminals are arranged on the upper and lower steps, the terminals in the lower step sensing the insertion of the thinner cards and the terminals in the upper step sensing the insertion of the thicker cards with the aid of the terminals in the lower step and transmitting the detected information to an information apparatus.

Moreover, when a plurality of cards are inserted into the respective card insertion spaces provided in the interior of the connector, the card of one kind inserted in the upper space contacts the card identification terminal near to the opening of the space, and the card of the other kind inserted in the lower space contacts the card identification terminal remote from the opening of the space, these terminals projecting into the spaces for contacting the cards to identify them.

The terminals each comprises a contact portion to contact a card, a fixing portion to be fixed to a connector body and a connection portion to be connected to a board and further comprise an engaging portion on an extension of said contact portion. The connector body is formed with insertion grooves for inserting the terminals, and the insertion grooves are each provided with an anchoring portion to engage the engaging portion of the terminal.

The connector for memory cards according to the invention has the following significant effects.

(1) The connector according to the invention can be used with card of a plurality of kinds without the aid of any other connectors, thereby contributing to the miniaturization of information apparatuses and reduction in manufacturing cost and the areas and spaces occupied by boards.

(2) The connector according to the invention is provided with card identification terminals on inner side walls, thereby enabling cards of a number of kinds to be inserted selectively or in stacked condition.

(3) According to the invention terminals are each provided with an engaging portion at its free end, and the connector body is provided with anchoring portions adapted to engage the engaging portions of the terminals, thereby eliminating jamming and buckling of cards when being inserted into the card receiving spaces of the connector.

(4) Eliminating the jamming and buckling of the cards according to the invention completely prevents any wrong electrical connection.

(5) According to the invention terminals are each provided with an engaging portion at its free end, and the connector body is provided with anchoring portions adapted to engage the engaging portions of the terminals so that no irregularity in gap between terminals, thereby accomplishing constant contact pressure between the terminals and cards.

(6) As the gaps between the terminals, and contact pressure between the terminals and cards are stable in the connector according to the invention, stable contact between the terminals and cards can be obtained.

The invention will be more fully understood by referring to the following detailed specification and claims taken in connection with the appended drawings.

DESCRIPTION OF THE PREFERRED EMBODIMENTS

Figure 1:
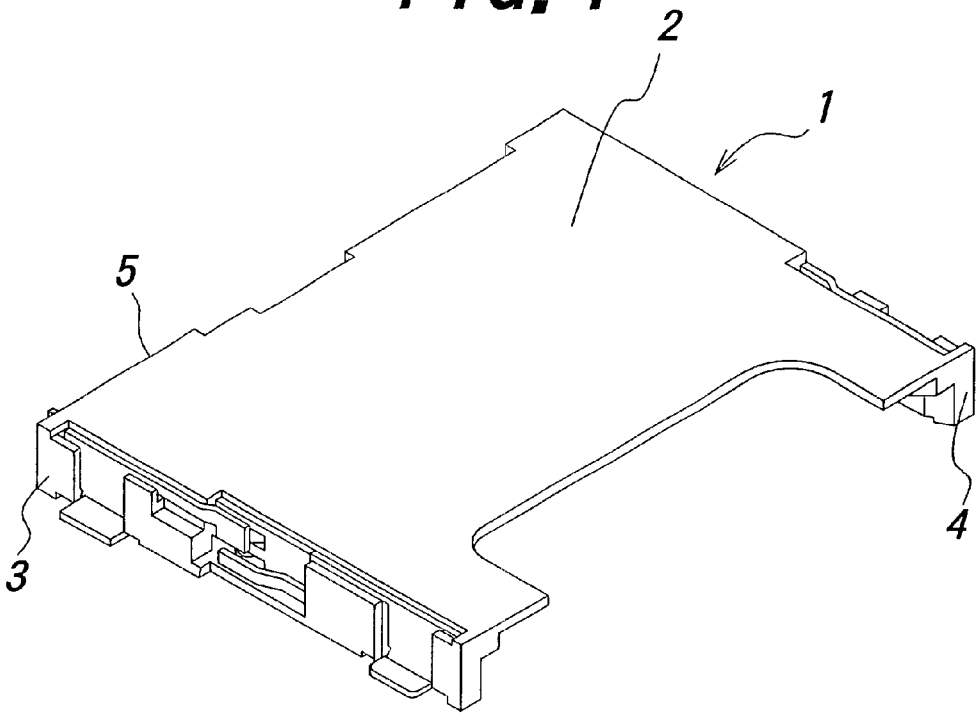
FIG. 1 is a perspective view illustrating a connector for memory cards according to one embodiment of the invention.
Figure 2:
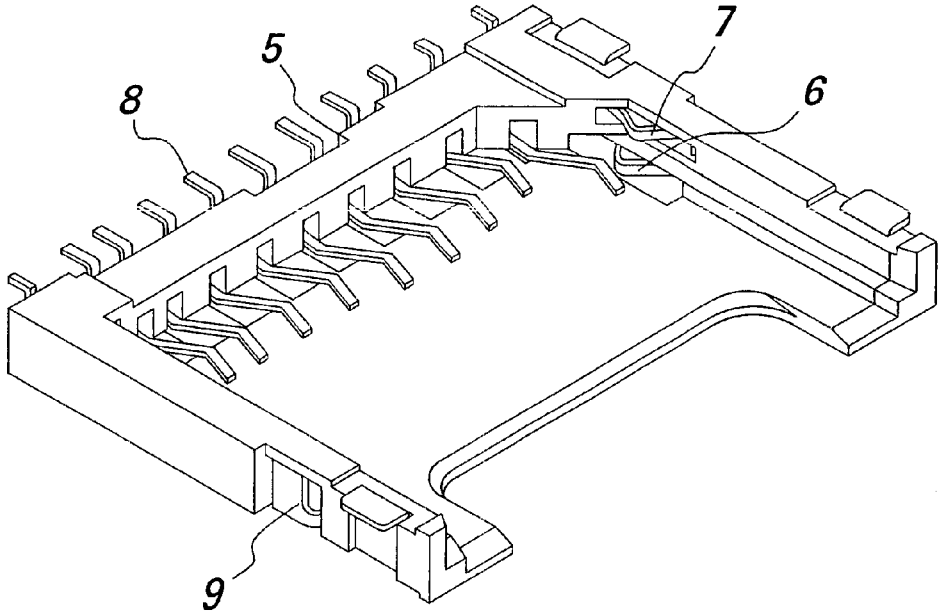
FIG. 2 is a bottom perspective view of the connector shown in FIG. 1.

With reference to FIGS. 1 and 2, a connector in accordance with one embodiment of the invention is shown in perspective views, which is suitable for use with SD cards and MMC cards. The connector 1 comprises a top cover 2, side walls 3 and 4 on both sides, and a rear wall 5. The side walls 3 and 4 are each formed along its overall length with a shoulder or step adapted to meet a side edge of an SD card. FIG. 2 illustrates the connector according to the invention which has been turned upside down. As shown in FIG. 2, the side wall 3 is provided on its inner surface with card identification terminals 6 and 7 located one above the other for identifying cards. Suitably arranged on the rear wall 5 are terminals 8 for writing electronic information into cards or reading stored information from cards, while suitably arranged at an appropriate location in the side wall 4 is a protection terminal 9 for the write-inhibit as in the conventional manner.

Figure 3:
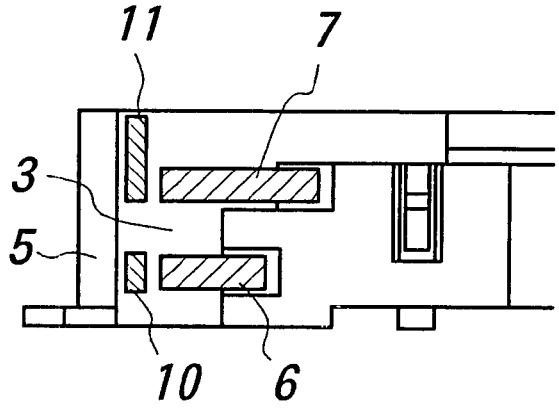
FIG. 3 is a sectional view of the connector shown in FIG. 1 illustrating the relation between card identification terminals and card identification terminal tabs prior to insertion of cards.
Figure 4:
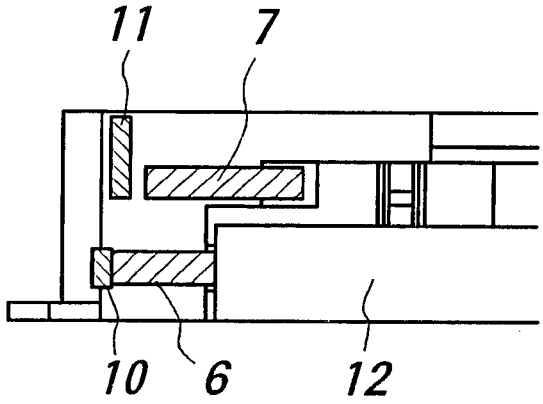
FIG. 4 is a sectional view of the connector shown in FIG. 1 just when a card (MMC card) has been inserted thereinto.
Figure 5:
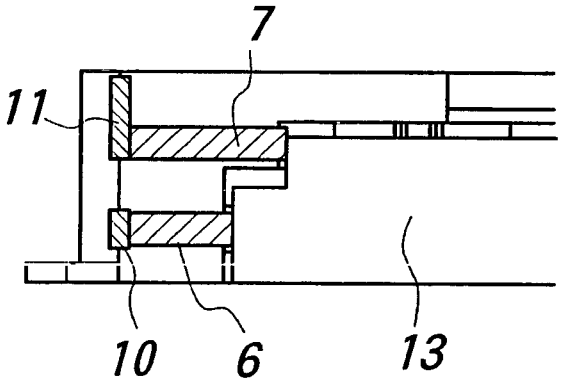
FIG. 5 is a sectional view of the connector shown in FIG. 1 just when a card (SD card) has been inserted thereinto.

As shown in sectional views of FIGS. 3 to 5, the card identification terminals 6 and 7 made of a springy metal strip are arranged one above the other on the inside of the side wall 3. Moreover, metal identification tabs 10 and 11 for identifying the existence of a card with the aid of contact of the identification terminals 6 and 7 are shown in FIG. 3 in a state that they are spaced from the terminals 6 and 7, respectively, when no cards have been inserted into the connector. FIG. 4 illustrates the state that an MMC card 12 has been fully inserted into the connector 1, wherein the insertion of the card 12 has been sensed by the fact that the terminal 6 has been forced into contact with the tab 10 by the insertion of the card 12. In FIG. 5, an SD card has been inserted into the connector 1 and the insertion has been sensed by the contact of the terminal 7 with the tab 11 in addition to the contact of the terminal 6 with the tab 10.

Although the connector for use with MMC and SD cards has been described in the above embodiment, it is to be understood that a connector may be formed with plural number of steps to have a cross-section different from that in the illustrated embodiments adapted to fit side edges of the plural types of memory cards and further provided with a plurality of card identification terminals and tabs arranged on one side wall in order to accommodate requirements different from those in the illustrated embodiment.

Figure 6:
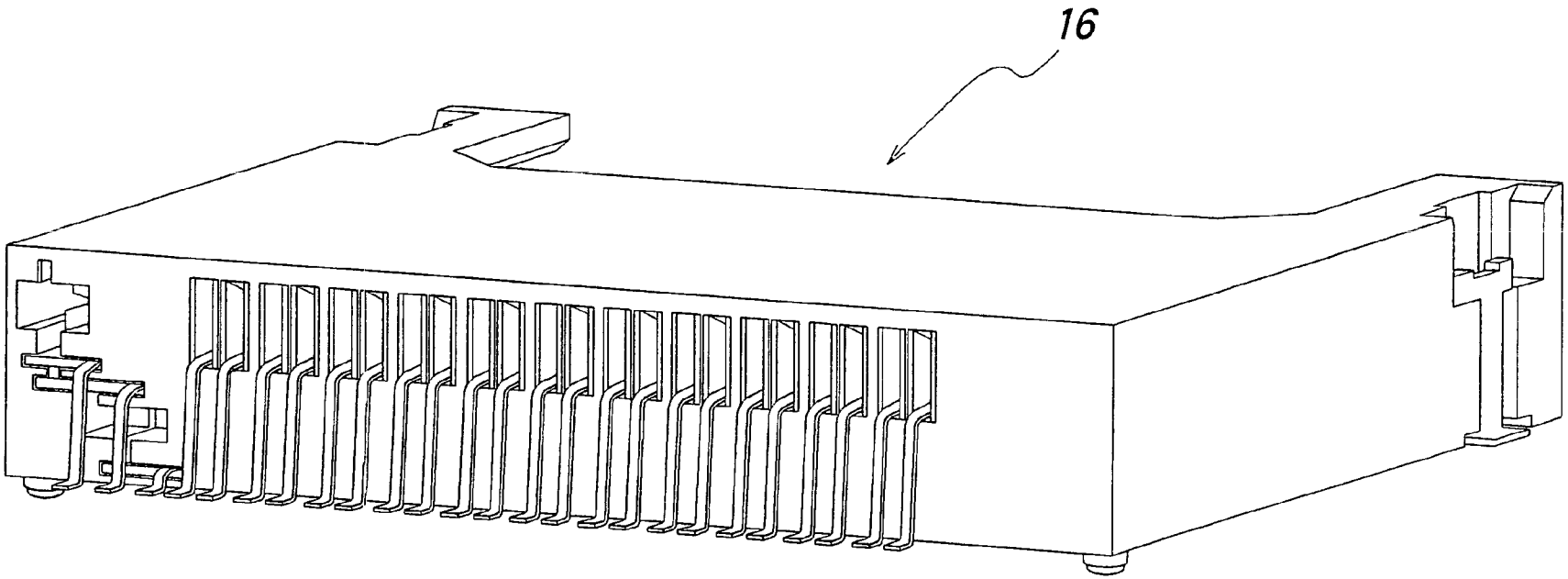
FIG. 6 is a perspective view illustrating the rear side of a connector for memory cards according to another embodiment of the invention.
Figure 7:
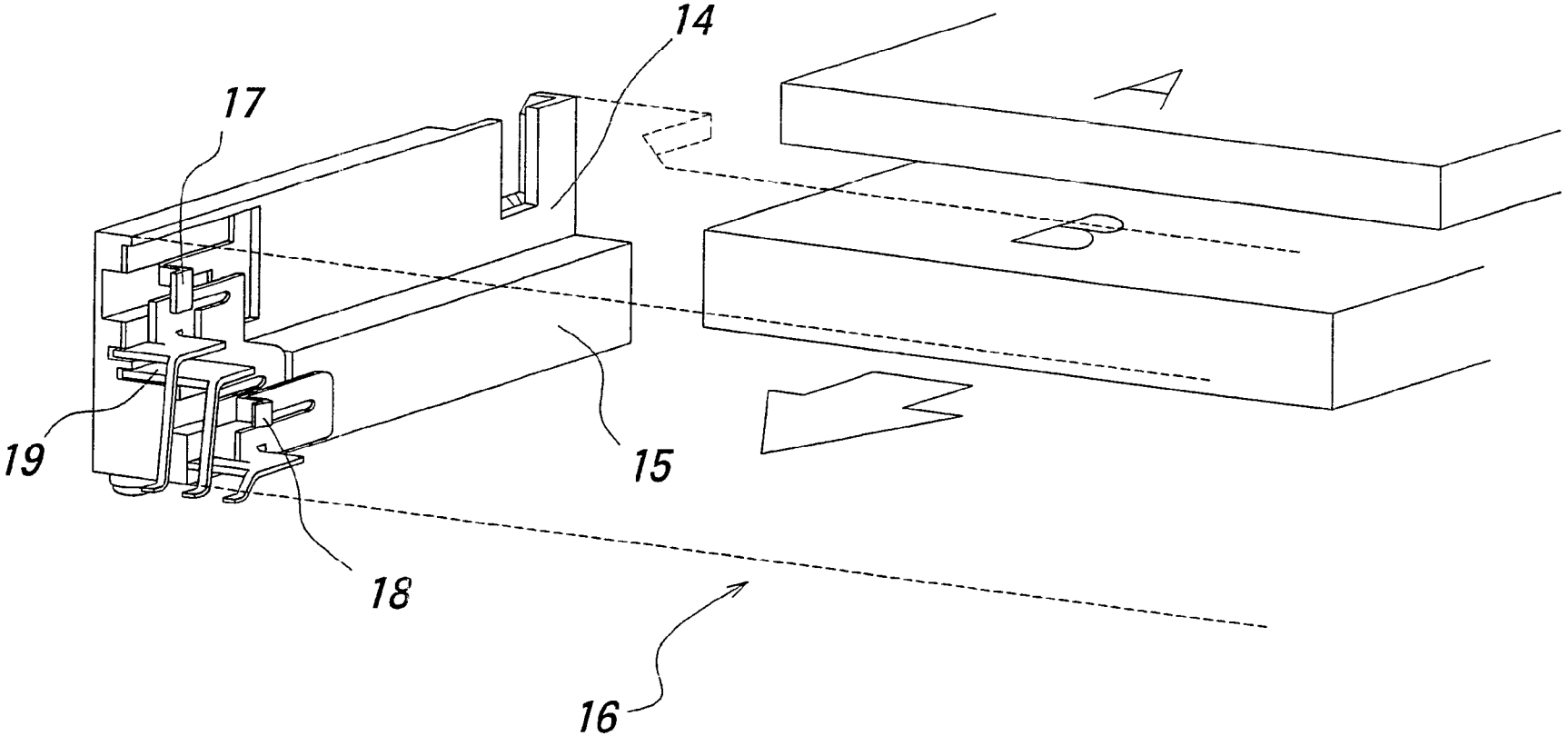
FIG. 7 is a partly sectional explanatory perspective view illustrating card identification terminals and tabs of the connector shown in FIG. 6.

FIGS. 6 and 7 illustrate a connector 16 in accordance with another embodiment of the invention. The connector 16 is formed with card insertion spaces 14 and 15 for memory cards A (SSFDC cards) and memory stick cards B (MS cards), respectively, and has terminals 17 and 18 made of a springy metal strip fixed to an inner wall of the connector 16 and metal identification tabs 19 provided on the inner wall. When a memory card A and a memory stick card B are suitably inserted into the card insertion spaces 14 and 15 of the connector 16, respectively, the terminals 17 and 18 are moved forward by the forward edges of the cards so that ends of the terminals 17 and 18 are brought into contact with the metal identification tabs 19, respectively, thereby electrically sensing the insertion of these cards.

As shown in FIG. 7, when a plurality of cards are inserted into the respective card insertion spaces provided in the interior of the connector, the card of one kind inserted in the upper space contacts the card identification terminal near to the opening of the space, and the card of the other kind inserted in the lower space contacts the card identification terminal remote from the opening of the space. These terminals project into the spaces for contacting the cards to identify them.

Figure 8:
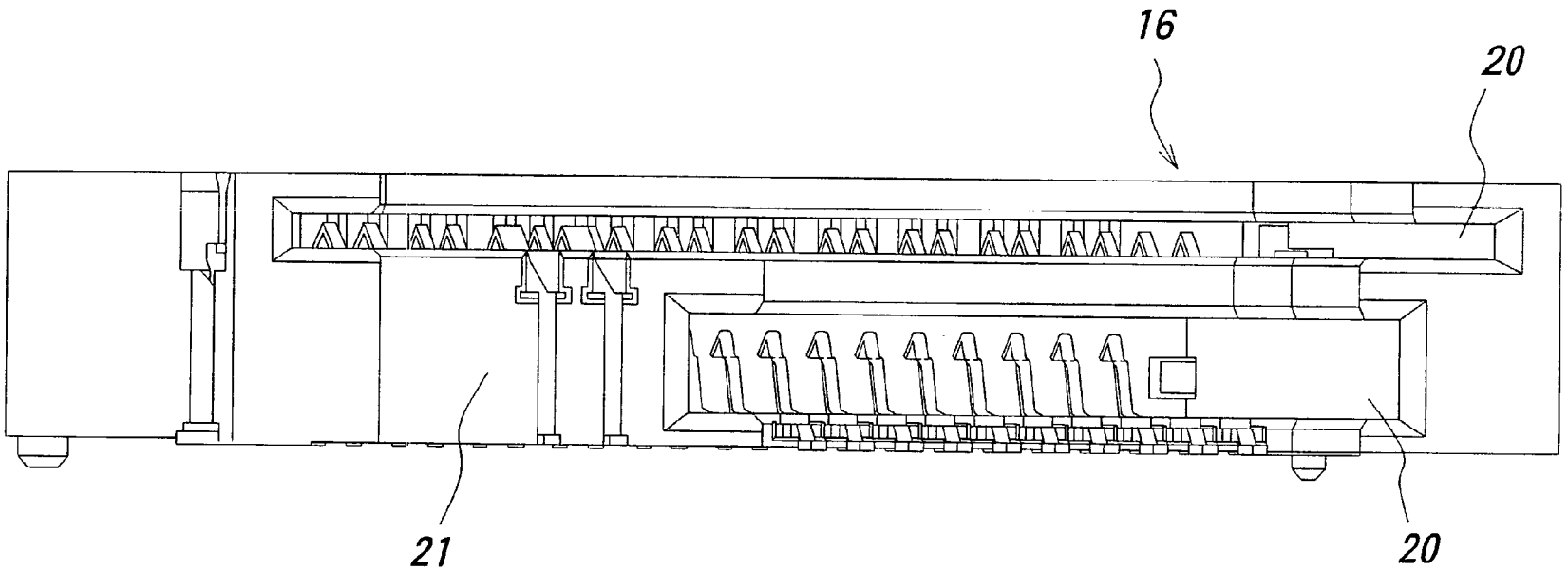
FIG. 8 is a front elevation of the connector shown in FIG. 6.

The connector 16 of an embodiment illustrated in FIG. 8 is provided with a front wall 21 formed with slots or card insertion openings 20 for inserting the cards, as the case may be. Marks or names indicating the cards may be provided on the front surface of the front wall 21 to prevent users from inserting wrong types of cards different from the proper types.

A connector 30 for memory cards according to a further embodiment of the invention will be explained by referring to FIGS. 9 to 12. The connector 30 for memory cards mainly comprises a connector body 32, a long terminal 34 for cards A, a short terminal 36 for the cards A, a terminal 38 for cards B, and card identification terminals 68, 70 and 72 for the respective cards. The connector 30 for memory cards can receive two different kinds of cards 52 and 54 therein, for example, an SSFDC card in the upper space and an MS card in the lower space.

The components of the connector 30 will be successively explained hereinafter with reference to FIGS. 9 to 12. First, the three terminals 34, 36 and 38 described above will be explained which are subject features of this illustrated embodiment. These terminals 34, 36 and 38 are made of a metal by the well-known press-working. Brass, beryllium bronze and phosphor bronze are used in the most cases for this purpose because they substantially comply with the imposed requirements for the springiness and electric conductivity.

These terminals 34, 36 and 38 each mainly comprise a contact portion adapted to contact a card, a fixing portion to be fixed to the connector body 32 and a connection portion adapted to contact a board. These terminals are divided into the long terminals 34 and the short terminals 36 respectively adapted to contact the cards A 52 in the upper space and the terminals 38 adapted to contact the cards B 54 in the lower space. The respective terminals are fixed in the connector body 32 with their contact portions projecting from insertion grooves for the terminals into insertion spaces 64 and 66 for the cards to bring them into contact with the corresponding cards inserted into the connector.

The long and short terminals 34 and 36 for the card A are each provided with an engaging portion 40 contiguous to the contact portion 42. In assembling this connector, these long and short terminals 34 and 36 are inserted into the insertion grooves 48 of the connector body 32 from the opposite side of the opening of the insertion space 64 of the connector for the card A and fixed thereat by press-fitting. With this insertion of the terminals into the insertion grooves in assembling, the free ends of the terminals 34 and 36 are positioned on that side toward which the cards are inserted into the connector 32, while the engaging portions 40 of the terminals 34 and 36 engage anchoring portions 50 of the insertion grooves 48 of the connector body 32, with the result that the card A 52 can be smoothly inserted into the insertion space 64 of the connector without jamming with the two terminals 34 and 36. In the illustrated embodiment, there are provided the two kinds of terminals as the long and short terminals 34 and 36 for the card A 52 in order to make them compatible with the positions where they contact the inserted card A 52. Positions of the connection portions of the terminals 34 and 36 are suitably determined so as to correspond to the pattern of the board.

In assembling the connector, the terminal 38 for the card B is inserted into the insertion groove of the connector body 32 from that side toward which the card B is inserted into the insertion space 66 and fixed to the connector body 32. With this insertion of the terminals into the insertion groove in such a direction, the free end of the terminal 38 is positioned remotely from the opening of the insertion space for the card B so that the card B can be smoothly inserted into the insertion space without any jamming of the leading end of the card B with the free end of the terminal, in conjunction with the contact portion of the terminal 38 generally curved in order to obtain the stable contact with the card. Therefore, the terminal 38 needs no engaging portion corresponding to the engaging portions 40 continuous to the contact portions 42 of the long and short terminals 34 and 36. However, the terminal 38 may be provided with such an engaging portion in order to more improve the stability in the contact with the card as the case may be. The terminal 38 is provided with a connection portion at a location suitably determined so as to correspond to the pattern of the board.

The connector body 32 is made of a plastic material by the known injection molding. Materials from which the connector body 32 is made are required to have a dimensional stability and a high mechanical strength and to be inexpensive, and hence polybutylene terephthalate (PBT), polyamide (PA) and polycarbonate (PC) are used in most cases for this purpose.

Figure 9:
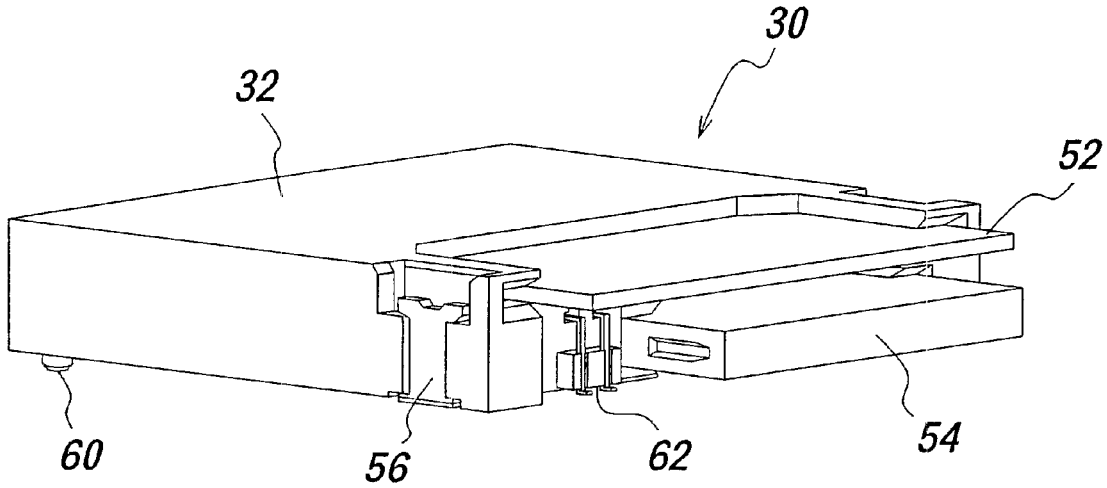
FIG. 9 is a perspective view of the connector for memory cards of a further embodiment of the invention.
Figure 10:
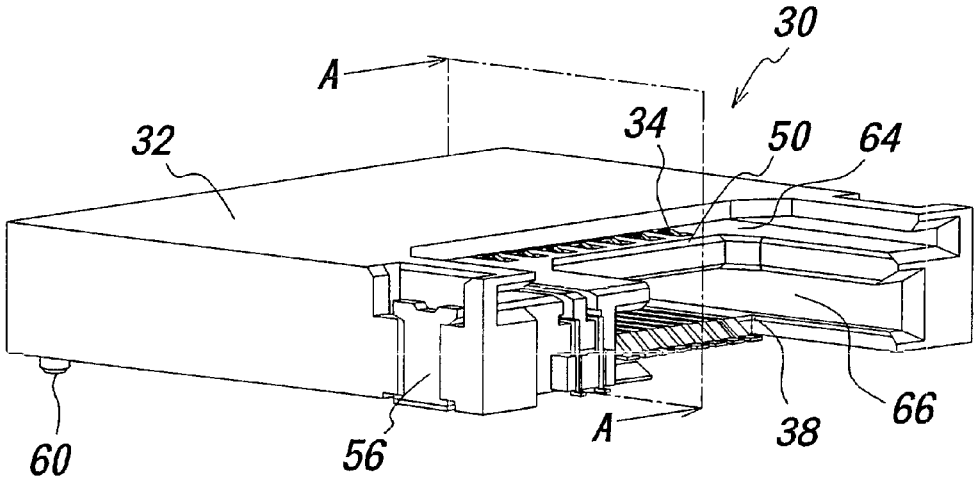
FIG. 10 is a perspective view of the connector shown in FIG. 9 partly illustrating in detail.
Figure 11:
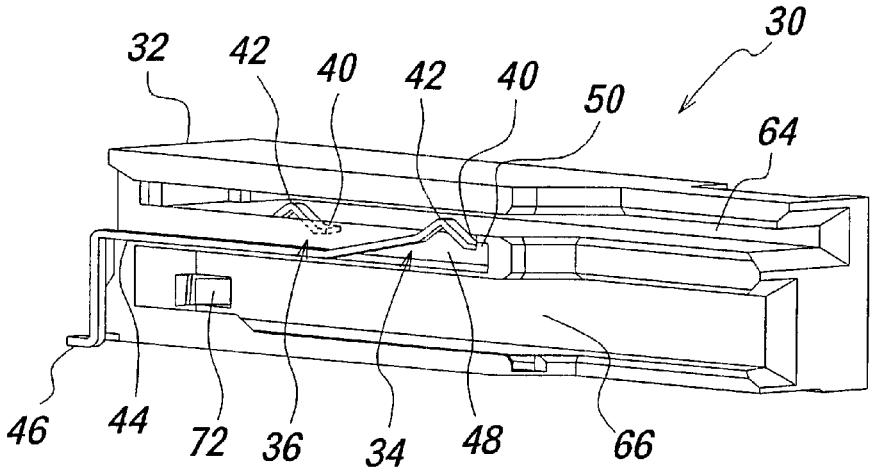
FIG. 11 is a sectional perspective view of the connector taken along a section A—A in FIG. 10.

As shown in FIG. 9, the connector body 32 is formed with the insertion space 64 for the card A 52 and the insertion space 66 for the card B 54, and further formed with insertion grooves for fixing therein the card identification terminals 68, 70 and 72. The insertion grooves for receiving the long and short terminals 34 and 36 are provided with the anchoring portions 50 extending in the direction opposite to the inserting direction of the card 52 and adapted to engage the engaging portions 40 of the long and short terminals 34 and 36. The anchoring portions 50 may extend in that direction by any suitable distance so long as the anchoring portions 50 permit to engage the engaging portions 40 of the long and short terminals 34 and 36.

Moreover, the connector body 32 is provided with positioning pins 60 extending from its surface facing to the board for facilitating the positioning of the connector relative to the board. The positioning pins 60 may be formed integrally with or separately from the connector body 32. The connector body in the illustrated embodiment is a U-shaped body.

Figure 12:
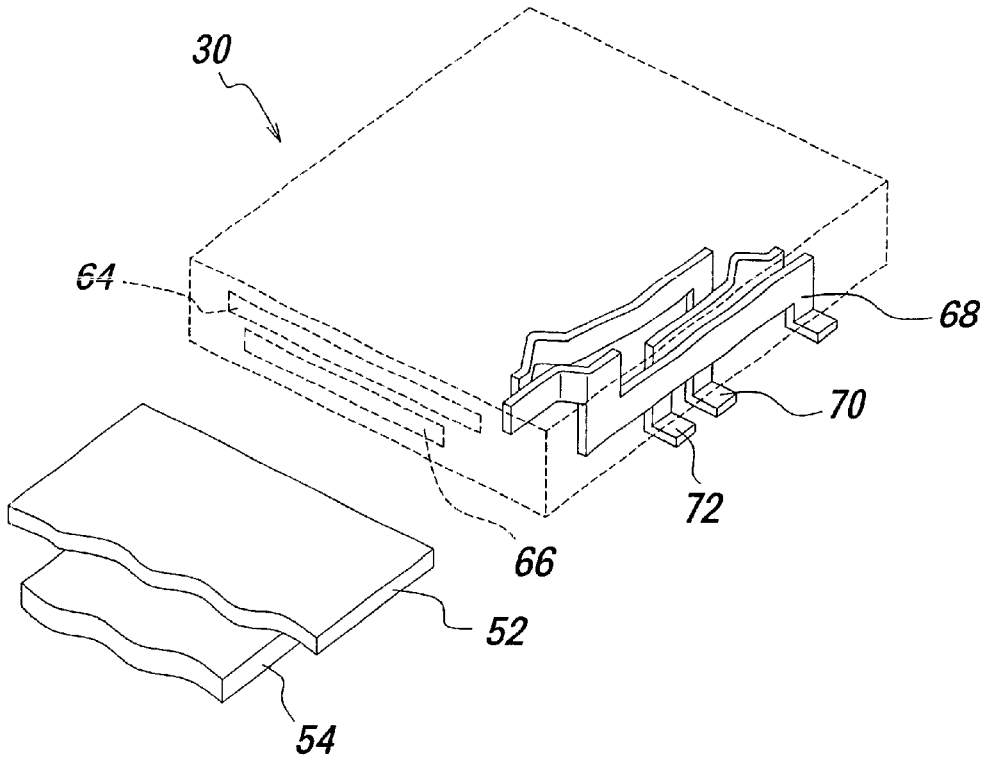
FIG. 12 is an explanatory perspective view for explaining switch terminals of the connector.

The respective card identification terminals 68, 70 and 72 will be explained by referring to FIG. 12. Similarly to the terminals 34, 36 and 38, these terminals 68, 70 and 72 are made of a metal by the well-known press-working. The same materials as those for the terminals 34, 36 and 38 may be used in the most cases because they substantially comply with the imposed requirements for the springiness and electric conductivity.

The card identification terminal 70 is arranged in the connector body with its contact portion projecting into the upper insertion space 64 so that when the card 52 is inserted into the upper insertion space 64, the card 52 contacts the contact portion of the card identification terminal 70 and the free end of the card identification terminal 70 deforms to contact the card identification terminal 68, thereby detecting whether the card 52 has been inserted or not.

The card identification terminal 72 is arranged in the connector body with its contact portion projecting into the lower insertion space 66 so that when the card B 54 is inserted into the insertion space 66, the card B 54 contacts the contact portion of the card identification terminal 72 and the free end of the card identification terminal 72 deforms to contact the card identification terminal 68, thereby detecting whether the card B 54 has been inserted or not.

As described above, the card identification terminal 68 fixed with its both ends to the connector body 32 has contact portions adapted to contact the card identification terminals 70 and 72, respectively, thereby detecting the insertion of the cards A 52 and B 54.

Metal fitting 56 are often used in connecting the connector 30 for memory cards to a board, in order to prevent the connector from being moved relative to the board due to jamming of a card being inserted into the connector 30. The metal fittings 56 are also formed of a metal by the well-known press working and connected to the board together with the terminals and card identification terminals by means of reflow soldering.

In this embodiment, there are provided write-inhibit terminals 62 whose contact portions extend into the insertion space 64 so as to contact a card 52. While there are two write-inhibit terminals in the illustrated embodiment, they may be dispensed with as the case may be.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector for memory cards comprising a connector body having side walls on both sides and a rear wall, said side walls formed over their length with card receiving portions to fit shapes of side edges and the number of the memory cards to be used, card identification terminals arranged in a plurality of steps on an inner surface of said side walls, and terminals suitably arranged on said rear wall for writing electronic information into cards and reading stored information from cards.

2. The connector for memory cards as set forth in claim 1, wherein said terminals arranged on said rear wall each comprise a contact portion to contact said card, a fixing portion to be fixed to said connector body, and a connection portion to be connected to a board and further comprise an engaging portion on an extension of said contact portion, and wherein said connector body is formed with insertion grooves for inserting said terminals, respectively, and said insertion grooves are each provided with an anchoring portion to engage said engaging portion of said terminal.

3. The connector for memory cards as set forth in claim 1, wherein one of said side walls of said connector body is provided with said card identification terminals made of a springy metal strip arranged in a plurality of steps, and identification tabs are each arranged spaced from said card identification terminal prior to insertion of a card, for identifying an existence of an inserted card with the aid of the contact between the inserted card and the card identification terminal.

4. The connector for memory cards as set forth in claim 3, wherein said card identification terminals are arranged in two steps one above the other so that when a thinner card is inserted into the connector, said thinner card contacts the card identification terminal in the lower step, and when a thicker card is inserted into the connector, said thicker card contacts both the card identification terminals in the upper and lower steps.

5. The connector for memory cards as set form in claim 4, wherein said connector body is provided with a front wall having a card insertion opening for inserting each type of cards.

6. The connector for memory cards as set forth in claim 1, wherein one of said side walls of said connector body is provided with said card identification terminals made of a springy metal strip arranged in a plurality of insertion spaces, and identification tabs are each arranged spaced from said card identification terminal prior to insertion of a card, for identifying an existence of an inserted card with the aid of the contact between the inserted card and the card identification terminal.

7. The connector for memory cards as set forth in claim 6, wherein said card identification terminals are arranged in two steps one above the other so that when a card of one type is inserted into the upper card insertion space of the connector, said card contacts the card identification terminal located nearer to an insertion opening for the card, and when a card of the other type is inserted into the connector, said card contacts the card identification terminal remoter from the insertion opening for the card.

* * * * *